US006615611B1

(12) United States Patent
Schachter et al.

(10) Patent No.: US 6,615,611 B1
(45) Date of Patent: Sep. 9, 2003

(54) HIGH YIELD DIAMOND

(76) Inventors: Michael Schachter, 4301 N. Ocean Blvd., Boca Raton, FL (US) 33431; Uri Peleg, 74 Shai Agnun, Herzaliah (IL)

( * ) Notice: Subject to any disclaimer, the term of this patent is extended or adjusted under 35 U.S.C. 154(b) by 0 days.

(21) Appl. No.: 09/669,137

(22) Filed: Sep. 26, 2000

(51) Int. Cl.[7] ..... A44C 17/00
(52) U.S. Cl. ..... 63/32
(58) Field of Search ..... 63/32

(56) References Cited

U.S. PATENT DOCUMENTS

| | | | | | |
|---|---|---|---|---|---|
| 1,291,506 | A | | 1/1919 | Heller | |
| 2,009,390 | A | | 7/1935 | Bayardi | |
| D137,163 | S | | 2/1944 | Goldstein | |
| 2,340,659 | A | | 2/1944 | Goldstein | |
| 3,286,486 | A | | 11/1966 | Huisman et al. | |
| 3,394,692 | A | | 7/1968 | Sirakian | |
| 3,528,261 | A | | 9/1970 | Jones | |
| 3,585,764 | A | | 6/1971 | Huisman et al. | |
| 3,796,065 | A | * | 3/1974 | Watermeyer | 63/32 |
| 3,808,836 | A | | 5/1974 | Jones | |
| 4,020,649 | A | | 5/1977 | Grossbard | |
| 4,118,949 | A | | 10/1978 | Grossbard | |
| 4,306,427 | A | * | 12/1981 | Urban | 63/32 |
| 4,308,727 | A | * | 1/1982 | Elbe | 63/32 |
| 4,555,916 | A | * | 12/1985 | Grossbard | 63/32 |
| 4,708,001 | A | | 11/1987 | Alburger | |
| 4,738,240 | A | * | 4/1988 | Aich | 125/30.01 |
| 5,072,549 | A | | 12/1991 | Johnston | |
| 5,186,024 | A | * | 2/1993 | Waters, Jr. | 63/32 |
| 5,462,474 | A | * | 10/1995 | Hansen | 451/41 |
| 5,657,646 | A | | 8/1997 | Rosenberg | |
| 5,722,261 | A | * | 3/1998 | Lehrer | 63/32 |
| 5,970,744 | A | | 10/1999 | Greeff | |

FOREIGN PATENT DOCUMENTS

| | | | | |
|---|---|---|---|---|
| CH | 684301 | | 8/1974 | |
| EP | 0016885 | * | 10/1980 | 63/32 |
| SU | 1694095 | * | 11/1991 | 63/32 |
| SU | 1743563 | * | 6/1992 | 63/32 |

* cited by examiner

*Primary Examiner*—J. J. Swann
*Assistant Examiner*—Andrea Chop
(74) *Attorney, Agent, or Firm*—Kevin P. Crosby, Esq.; Brinkley, McNerney & et al.

(57) ABSTRACT

A high yield diamond and method of producing same. The diamond includes a plurality of main crown facets adjacent a table lying at an angle of between 23° and 40° relative to the table, a girdle, a plurality of upper pavilion facets below the girdle lying at an angle of between 45° and 80° relative to the girdle plane, and a plurality of lower pavilion facets formed between the upper pavilion facets and the culet. The upper pavilion facets extend from between one fifth to four fifths the height of the pavilion. The method is directed to a process for blocking the pavilion of the diamond prior to performing any brillianteering steps.

4 Claims, 12 Drawing Sheets

HIGH YIELD DIAMOND

BACKGROUND OF THE INVENTION

1. Field of the Invention

This invention relates to the art of transforming rough diamonds into faceted, brillianteered diamonds, and, more particularly, relates to a method for cutting and faceting diamonds in such a way that the yield obtained in the finished product is significantly increased over yields previously obtained by existing cutting and faceting techniques.

2. Description of the Prior Art

The art of polishing facets on gemstones (other than diamonds) has been around for many centuries. The first known attempt to facet a diamond is believed to have taken place in the eleventh century. At that time, eight triangular faces were polished in the rough diamond, creating what became known as the "point cut", which resembled a pair of pyramids joined at their bases.

In the early part of the fourteenth century, a single, horizontal planar facet was introduced, which became known as the "table", leaving four natural beveled surfaces that created the crown. Further refinement of this elemental configuration has resulted in, among others, the round brilliant cut, which is the most popular faceting configuration for today's diamonds.

Currently, diamonds are first cut into a top or crown and a bottom, base or pavilion, and a girdle lying between the two in a horizontal plane. Anywhere from four to sixteen sections (top primary facets) are cut into the top section, oriented at roughly 34.5° above horizontal. Anywhere from four to sixteen sections (bottom primary facets) are also cut into the bottom, oriented at roughly 40.75° below horizontal. This phase of the cutting process is known as "blocking". It is almost universally accepted that these proportions and angles for brilliant cut diamonds are necessary to produce maximum brilliancy with a high degree of dispersion or "fire". Thereafter, additional facets are added to the top and bottom sections in a second phase known as brillianteering. This approach is shown in FIGS. 1 and 2. FIG. 1 shows a stone with eight main facets in the crown and eight main facets in the pavilion (i.e. after the rough has been "blocked"), while FIG. 2 shows the same stone after brillianteering facets have been added.

Eventually, stone cutters became aware of and began to understand the effects of refraction and reflection on the optical path of light within the gem and how to control it through angles, surfaces and proportions. As the art of gem cutting evolved, it has become widely accepted that the brilliant cut is the optimal cut for simultaneously maximizing the fire, lustre, scintillation and brilliance of the stone. Since, in general, the stone is viewed by looking down at the table and crown facets, it is desirable to induce the maximum amount of light possible through the table and crown facets, down into the stone where it is reflected off of the interior surfaces of the base facets across to the opposite base facets and then back out through the table and crown facets to the viewer. The more optimal the configuration of the stone, the more even, intense and uniform is the thus reflected dome of light perceived by the viewer.

Diamonds have various characteristics that distinguish them from other gemstones. One characteristic is brilliance, which can be further categorized into external and internal. External brilliance, also referred to as lustre, generally refers to the amount of light that impinges on the top of the stone and reflects back, rather than light that enters the stone. Internal brilliance is determined by the light rays that enter the crown and reflect off the base facets and back out through the top or crown as amplified (i.e. focused) light.

Another characteristic of a diamond is dispersion, also known as fire, which is a measure of how much the white light is broken up into the spectral colors. A ray of white light striking a prism will be split up into component colors of red, orange, yellow, green, blue, indigo and violet. Dispersion is maximized when a ray of light is reflected totally from base facets and strikes the ground facets at the greatest possible angle. Dispersion is observed when a diamond moves relative to an observer.

Another characteristic of a diamond is scintillation, which is an indication of the different light patterns obtained when the stone is moved under light. Expressed in another way, scintillation is the quantity of flashes observed from the diamond when either the diamond, light source or observer moves.

The refraction index for a diamond is 2.417, which is the highest for a transparent natural gem. The amount of dispersion of light, or fire, depends on the original angle of incidence and the distance the light travels inside the stone. The larger the angle of incidence, the larger the amount of refraction within the stone, and the greater the dispersion. White light is a blend of the spectral colors and because each color slows and bends differently this causes the light to disperse into spectral colors, which creates the fire within the diamond.

Today's diamond consumer is typically a highly discriminating and well educated shopper, looking for the highest value out of his or her investment. At the same time, the diamond supplier wants to obtain the highest yield from a given piece of rough. Currently, 10%–50% retention is good for a brilliant cut diamond. Since the price per carat increases exponentially in proportion to the carat weight of a particular stone, it is highly desirable to increase the yield, and conversely decrease the waste, from a given rough. The same light and dispersion can be obtained at less cost through weight retention during the faceting process.

In the past, however, the yield obtained in creating a faceted stone has been unnecessarily limited due to the belief that, in order to obtain acceptable light dispersion (i.e. reflection and refraction), the angle of the base facets should not exceed 43%.

Thus, the desire for weight retention has given way to what has been believed to be the need to keep the angle of the base or pavilion facets in a range of between 38° and 43° relative to a horizontal plane. The result of this practice is that, in order to cut the base facets at the presently specified range of angles between 36° and 43°, an unnecessary amount of waste occurs during cutting of the stone, including unnecessarily limiting the diameter of the finished product.

Therefore, it is desirable to present a method for creating a higher yield diamond which exhibits virtually identical visual effects and light performance as today's modern or brilliant cut.

One attempt at increasing the weight of diamonds utilized a greater table spread (the ratio of the table diameter to the girdle diameter). However, it was found that the circumferential surface of the girdle would be reflected off of the base facets through the table, creating what is know as the "fish-eye" effect. Attempting to decrease the base facet angle to prevent this unwanted effect deleteriously affected the stone's fire.

U.S. Pat. No. 5,970,744 to Greeff and assigned to Tiffany and Company is directed to a cut cornered mixed-cut square gemstone having a two-step crown, a girdle, and a pavilion. The pavilion sides and corners are defined by eight rib lines which extend continuously from the girdle to the culet. The first crown step has an angle of about 41°–44° relative to the girdle plane and the angle of the second crown step is about 36° to 39° to the girdle plane. The rib lines in the pavilion are preferably at an angle of between 38°–42° relative to the girdle plane.

U.S. Pat. No. 5,657,646 to Rosenberg discloses a new cut for a precious or semi-precious jewel having two or more culets and at least one additional facet extending from the end of the jewel (girdle) to the extra culet at an angle of 41° (for diamonds).

U.S. Pat. No. 5,072,549 to Johnston discloses a method of cutting facets on a gemstone, as well as the resulting stone, wherein facets are cut which produce a five-legged star which appears beneath the gem table. The product produced by this method comprises a pavilion having thirty facets and fifty edges, a crown having twenty-one facets and thirty-five facets, and a five-sided girdle.

U.S. Pat. Nos. 3,286,486 and 3,585,764 to Huisman et al disclose a brilliant-cut diamond having a pavilion formed of seventy-two facets and a total of one hundred and six overall. In the pavilion, there are eight kite-shaped (main pavilion) facets at 41° relative to the horizontal girdle plane, sixteen kite-shaped facets at 45°–47° relative to the girdle plane, sixteen star or diamond shaped facets at 53° to 54° from the girdle plane and 32 triangular facets at 58°–60° relative to the girdle plane. As such, the pavilion defines a tapering upper area ranging from 58°–60° to 41° at the base thereof. The sixteen kite-shaped facets, although not beginning at the girdle, appear to extend along roughly half of the pavilion. Stones cut in accordance with the Huisman patents are not of higher yield, however, because the star and half of necessity facets are added after the bottom pavilion facets have already been cut.

As a result of the physical principles discussed above, varying the proportions of the facets of the stone will effect the appearance of the stone. At present, the gem industry has accepted the theory that the optimal angle of the base facets is roughly 41°. It has been stated by one well-known authority on the subject that deviation of 0.25% from that angle will dramatically affect the appearance of the stone. However, the inventors herein have discovered, in the process of attempting to increase the yield for cut stones, that, by blocking the stone in a certain "manner" using the technique of this invention, virtually the same visual characteristics can be obtained while also obtaining upwards of a 15% greater yield than has been available with existing techniques.

As used herein, the term "diamond" refers to both natural and man-made diamonds.

SUMMARY OF THE INVENTION

It is, therefore, a principle object of this invention to provide a diamond which exhibits acceptable visual properties while yielding greater weight retention out of a given parcel of rough.

It is also an object of this invention to provide a technique for producing such a diamond.

In accordance with these and other objects, the invention is directed to a method for girdling, blocking and faceting a diamond in such a way that the resulting product has a substantially higher yield than has heretofore been achieved while retaining optimal visual performance.

Another aspect of the invention is the resulting cut stone, which exhibits the aforementioned visual characteristics while being of a higher yield than previously achievable from a given quantity of rough and while maintaining the desirable ratio of diameter to height. In general, the product is comprised of a diamond, which may for example but not by way of limitation be a round brilliant cut gemstone, comprising a girdle, a top or crown above the girdle and a pavilion or base below the girdle. For purposes of this description, the girdle will be deemed to lie in a horizontal plane ("girdle plane"). The crown terminates in an upper planar surface known as a "table", which is generally parallel to the girdle plane. The pavilion ends at its lower most end with a culet, which may be either a point or a planar surface or any other faceting arrangement desired without affecting the scope or principles of this invention. In one embodiment, the pavilion is comprised of a series of facets, some of which make up an upper pavilion, and another series of facets below the upper pavilion facets which constitute the lower pavilion. The stone may be divided into four to sixteen main top facets and four to sixteen main bottom facets as a result of the blocking step, which will be discussed in more detail below. "Blocking" is the step in the diamond cutting process in which the initial angles and primary facets are created from the rough stone, and "brillianteering" is the subsequent step during which secondary or minor facets are polished into the stone.

According to the invention, the height of the upper pavilion girdle is greater than 20% but preferably less than approximately 80% of the total pavilion height. The pavilion height is the distance from the girdle to the culet. The angle of each upper pavilion facet is between 45° and approximately 80° from a horizontal plane, and the lower pavilion facets are set at the customary angle of 38° to 44°. The crown break angle, which is an angle of the crown facets relative to the girdle plane, is preferably between 26° and 35°.

The resulting visual performance of the stone configured as described herein is surprising and striking, yet virtually indistinguishable from prior art stones, while at the same time resulting in a higher yield for a given quantity of rough material from which the stone is cut.

Such a result is achieved by creating the pavilion break angle, which is the angle at which the upper pavilion facets lie relative to the girdle plane, at between 45° and 80° during blocking. Additionally, the cutter determines the appropriate position for the girdle to create a larger girdle diameter than has heretofore been achieved, but the average depth can remain similar and even identical in some instances. The "average depth" is the ratio of the height of the diamond to its diameter. Additionally, the lower pavilion facets are cut at the accepted angle of somewhere in the range of 38° to 44°. As stated above, the height of the upper pavilion facets are preferably between 20% and 80% of the overall height of the pavilion. Consequently, the lower pavilion facets are between 80% and 20% of the pavilion height.

It has been found that by blocking the pavilion break angle at an angle of 45° to approximately 80° and cutting the lower pavilion facets at an angle of between 38° and 44°, a higher yield is achieved than if the pavilion break angle was first cut at 38° to 44° and thereafter the bottom pavilion facets were cut back further to the 45° to 80° angle. All that is required, however, is that the upper pavilion facets be cut at the preferred angle range of 45° to 80° and the lower pavilion facets at the standard angle of 38° to 43° before any brillianteering facets are made. It does not matter in what order the main crown or pavilion facets are cut. For example, Huisman patents both disclose a stone which is arrived at by first blocking the pavilion facets at a 41° angle and thereafter cutting away additional material, which merely creates star facets, to arrive at steeper angles up to 60°. In doing so, the opposite result to that achieved by this invention results. That is, unnecessary gem volume is cut away and wasted. More particularly, the Huisman patents require the angling above 41° to occur during brillianteering and not during blocking.

The diamond of the instant invention may otherwise be cut as a standard brilliant; or may be provided with a totally different faceting arrangement, so long as the angle and depth of the bottom pavilion facets are made in accordance with the invention.

The technique disclosed herein results in a product which is completely unexpected and dramatically superior to what conventional wisdom in the field would predict.

BRIEF DESCRIPTION OF THE DRAWINGS

FIGS. 15A–18 show a further embodiment of this invention in which a "cushion" cut is employed but which otherwise follows the principles of the invention.

DESCRIPTION OF THE PREFERRED EMBODIMENTS

Figure 1:
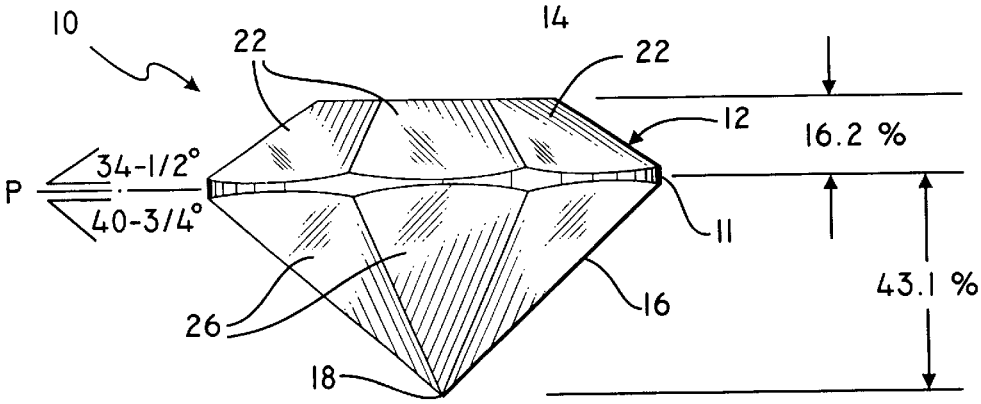
FIG.1 ( PRIOR ART )
FIGS. 1 and 2 show prior art round brilliant cut diamonds employing a commonly accepted pavilion or base facet orientation.

Referring now to the drawings, FIG. 1 is a side elevational view of a diamond 10 blocked in accordance with prior art techniques. Diamond 10 is comprised of a top or crown 12 terminating at its upper end with a horizontal table 14 and at its lower end at a horizontal girdle 11 lying in a girdle plane P. Diamond 10 also comprises a base or pavilion 60 extending from the girdle 11 to a culet 18. The main top facets 22 and main pavilion facets 26 give diamond 10 its initial shape and its volume. Top main facets 22 are oriented at an angle of 34.5° relative to the girdle plane P. Upper pavilion facets 26 are oriented at an angle of 40.75° below the girdle plane as described earlier. The figures to the right in FIG. 1 describe the ratio of the height of that section to the diameter of the stone. This dimension is called the "percentage of crown height" when referring the crown section (16.2% in FIG. 1) and "percentage of pavilion height" when referring the pavilion section (43.1% in FIG. 1).

Figure 2:
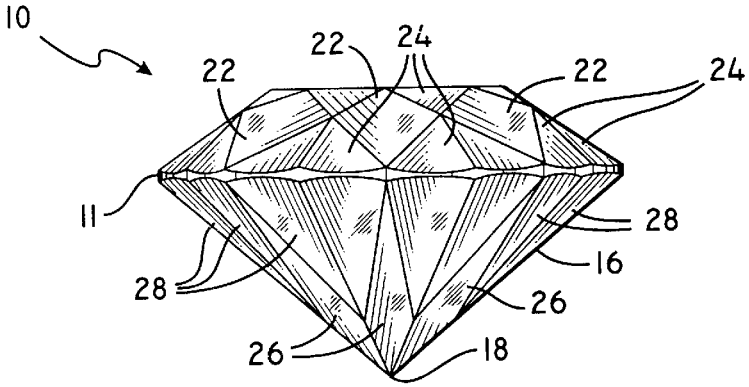
FIG.2 ( PRIOR ART )

FIG. 2 shows the diamond 10 of FIG. 1 after brillianteering facets have been added. These brillianteering facets, although enhancing the light performance of the finished diamond, do not in any way increase the volume and resulting carat weight of the stone.

Figure 3:
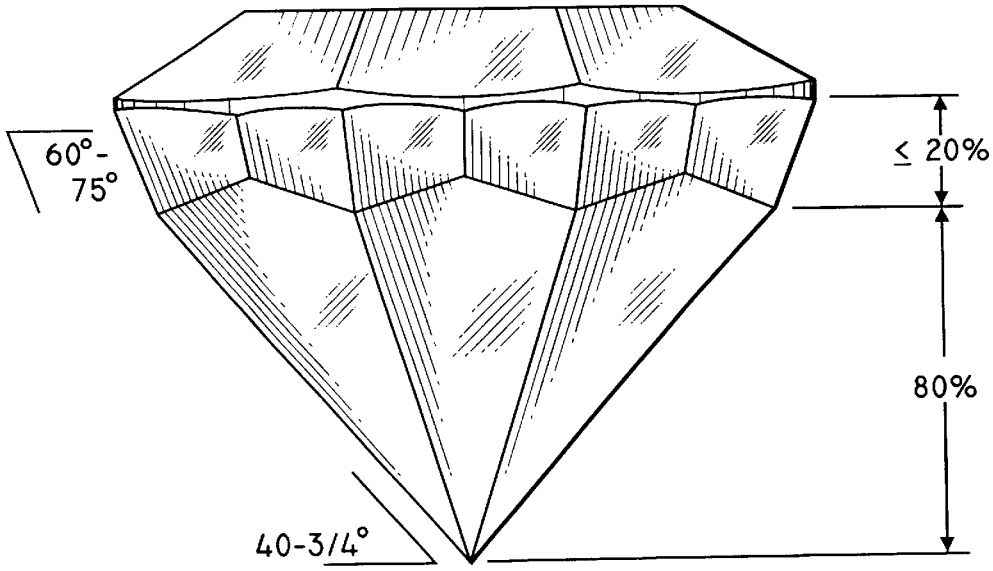
FIG.3 ( PRIOR ART )
FIG. 3 shows a prior art round brilliant barion cut diamond which utilizes faceting similar to that shown in FIGS. 1 and 2 but which also includes a series of "half-moon" pavilion facets which do not exceed 20% of the pavilion height.

FIG. 3 shows an alternative prior art round brilliant cut diamond in which a series of so-called "half-moon" facets 30 are arranged below the girdle. These half-moon facets 30, although oriented at an angle greater than the angle of 40.75° required by the prior art, do not exceed 20% of the height of the pavilion. In fact, the prior art mandates that this relationship not be exceeded.

Figure 4A:
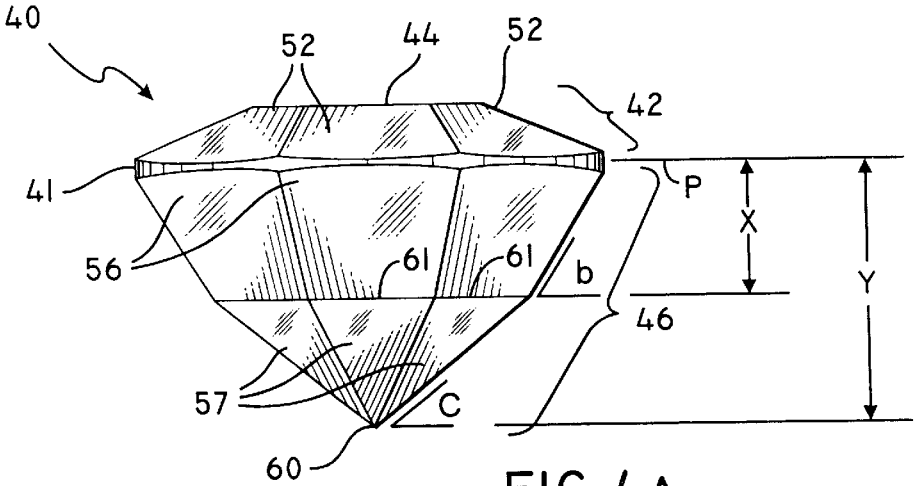
FIG. 4A is a side elevational view of a generalized representation of a diamond in accordance with this invention.
Figure 4B:
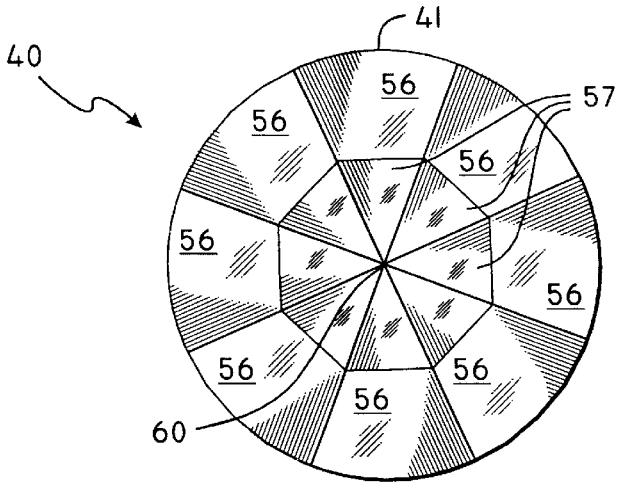
FIG. 4B is a bottom plan view of the diamond shown in FIG. 4A.

FIGS. 4*a* and 4*b* depict a generalized representation of a first embodiment of the instant invention in which a diamond 40 is shown, comprised of a top or crown section 42, a base or pavilion section 46 and a girdle 41 lying therebetween in a girdle plane P. The crown 42 terminates in a table 44 which is, for the preferred embodiment but not necessarily by way of limitation, parallel to girdle plane P. During blocking, a series of main crown facets 52 are created at an angle "a" between 26° and 35° above girdle plane P. In addition, a series of upper pavilion facets 56 are provided, which lie at an angle "b" below the girdle plane P. Finally, a series of lower pavilion facets 57 are provided, which lie at an angle "c" below the girdle plane. The height "x" of the upper pavilion facets are between 20% and 80% of the overall pavilion height "y". The order in which main facets 52, 56, 57 and 44 are cut does not matter, any such order being deemed to fall within the scope of this invention.

In order to manufacture a diamond 40 in accordance with the principles of this invention, table 44 is formed along with anywhere from four to sixteen main crown facets at angle "a". In addition, from four to sixteen upper pavilion facets 56 are provided at angle "b", extending from girdle 41 to whatever position the cutter deems appropriate during blocking. By thus blocking diamond 40, a higher girdle is obtained than with prior art techniques, along with a greater girdle diameter, although the average depth (ratio of overall height of diamond to diameter of girdle) remains commensurate with prior art diamonds, a desirable result.

In addition, lower pavilion facets 57 are provided at angle "c", extending upwardly from a newly formed culet 60 by a distance which will result in the ratio of "x" to "y" being between 20% and 80%. Rib lines 61 delineate upper pavilion facets 56 from lower pavilion facets 57.

Figure 6:
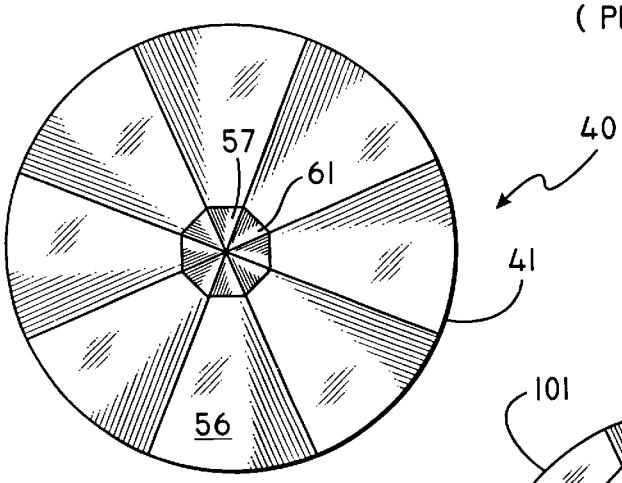
FIG. 6 is a bottom plan view of the diamond of FIG. 5.
Figure 5:
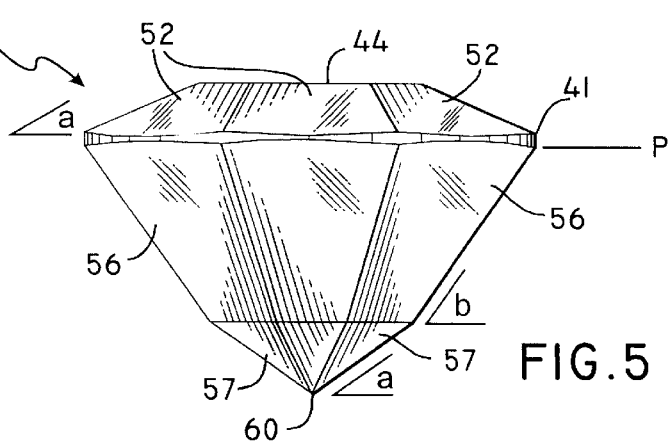
FIG. 5 is a side elevational view of an alternative embodiment of the invention which shows a particular faceting configuration in accordance with this invention in which the upper pavilion facets are approximately 80% of the height of the pavilion and oriented at an angle "b" of approximately 70° to the girdle plane.

FIGS. 5 and 6 show a blocked diamond 40 in accordance with the invention where upper pavilion facets 56 are sized to be approximately 80% of the overall pavilion height "y", but wherein the remaining dimensions are as set forth with respect to the description of FIGS. 4A and 4B.

Figure 7:
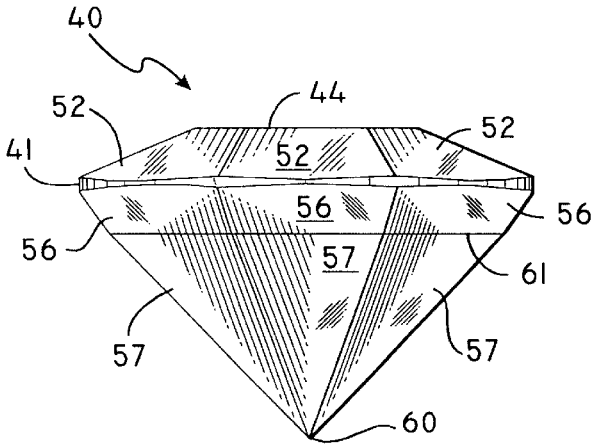
FIG. 7 is a side elevational view of a still further embodiment of the invention in which the upper pavilion facets constitute approximately 20% of the overall height of the pavilion, and are angled at approximately 70° to the girdle plane.
Figure 8:
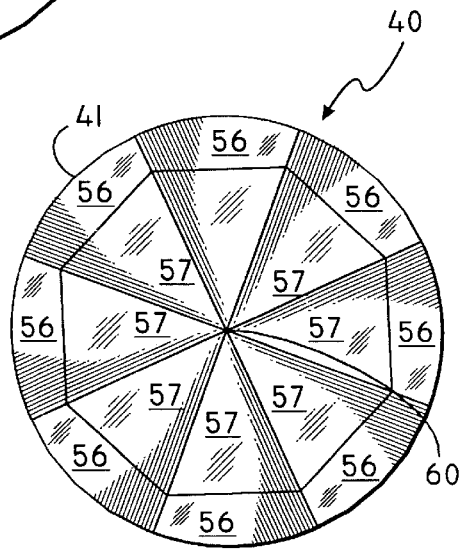
FIG. 8 is a bottom plan view of the diamond of FIG. 7.

FIGS. 7 and 8 show a diamond 40 in accordance with this invention in which the upper pavilion facets are approximately 20% of the overall height "y" of pavilion 46, but wherein the remaining dimensions are as set forth with respect to the description of FIGS. 4A and 4B.

Figure 9:
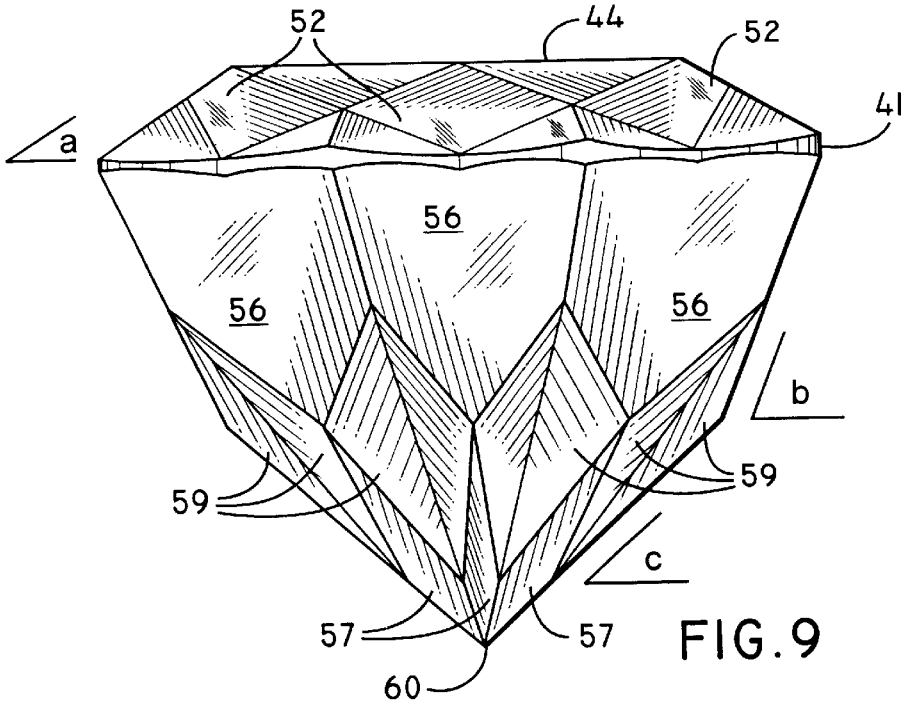
FIG. 9 is a side elevational view of the invention with brillianteering facets added to the crown and pavilion.
Figure 10:
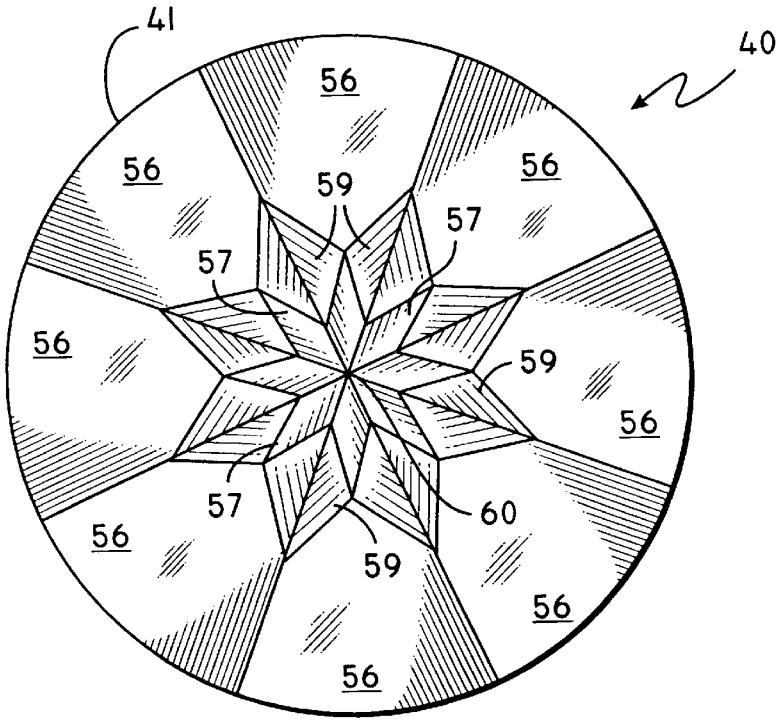
FIG. 10 is a bottom plan view of the diamond of FIG. 9.

FIGS. 9 and 10 illustrate a diamond 40 in accordance with this invention after having been brillianteered. It is important to point out that the brillianteering phase is irrelevant to the principles of this invention, and that eventually any brillianteering steps can be taken which may occur to one skilled in the art without departing from the scope of this invention.

Figure 11B:
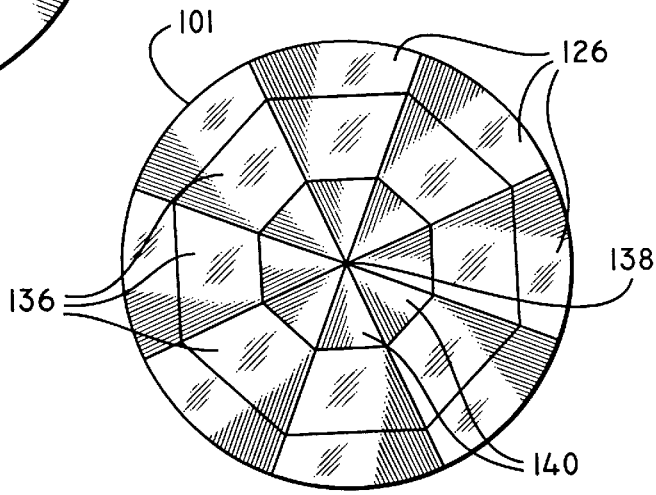
FIG. 11B is a bottom plan view of the diamond of FIG. 11A.
Figure 11A:
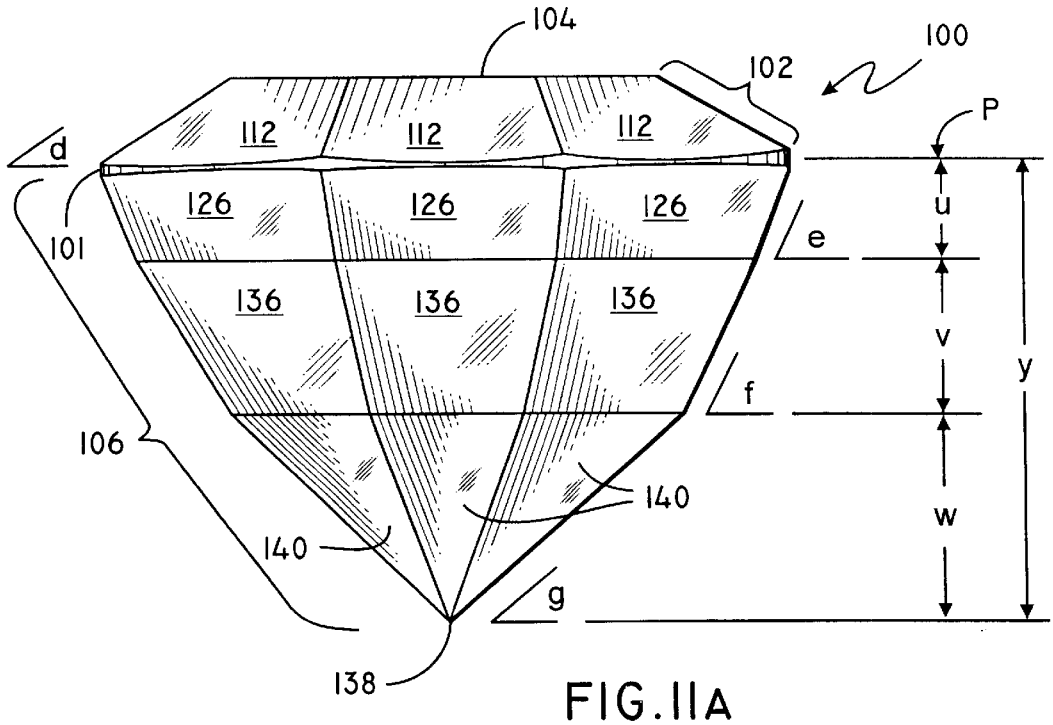
FIG. 11A is a side elevational view of another embodiment of the invention.

FIGS. 11A and 11B show a modified embodiment of this invention which is directed to a diamond 100 having a girdle 101, a crown 102, and table 104 and a pavilion 106. The pavilion height is indicated by the letter "y" and is the distance from the girdle plane P to culet 138 shown in FIG. 11A.

As can be appreciated from the description given with respect to FIGS. 4A and 4B, in order to create a diamond 100 in accordance with FIGS. 11A and 11B a cutter would block four to sixteen main crown facets 112 and a table 104 above girdle plane P. Facets 112 are cut an angle "d" relative to girdle plane P. In addition, four to sixteen upper pavilion facets 126 are created. A girdle 101 is created therebetween. Facets 126 are disposed at an angle "e" relative to the girdle plane F. Also, middle pavilion facets 136 are created, at an angle "f" relative to the girdle plane. Finally, lower pavilion facets 140 are created, at an angle "g" relative to the girdle plane P, resulting in culet 138. The angle "d" is preferably between 26°–35° relative to plane P, and angles "e" and "f" are between 45° and 80° relative to plane P. The dimensions "u", "v" and "w" may assume any proportion in relationship to height "y" of pavilion 106, so long as the sun of "u" and "v" are between 20% and 80% of "y".

Figure 12:
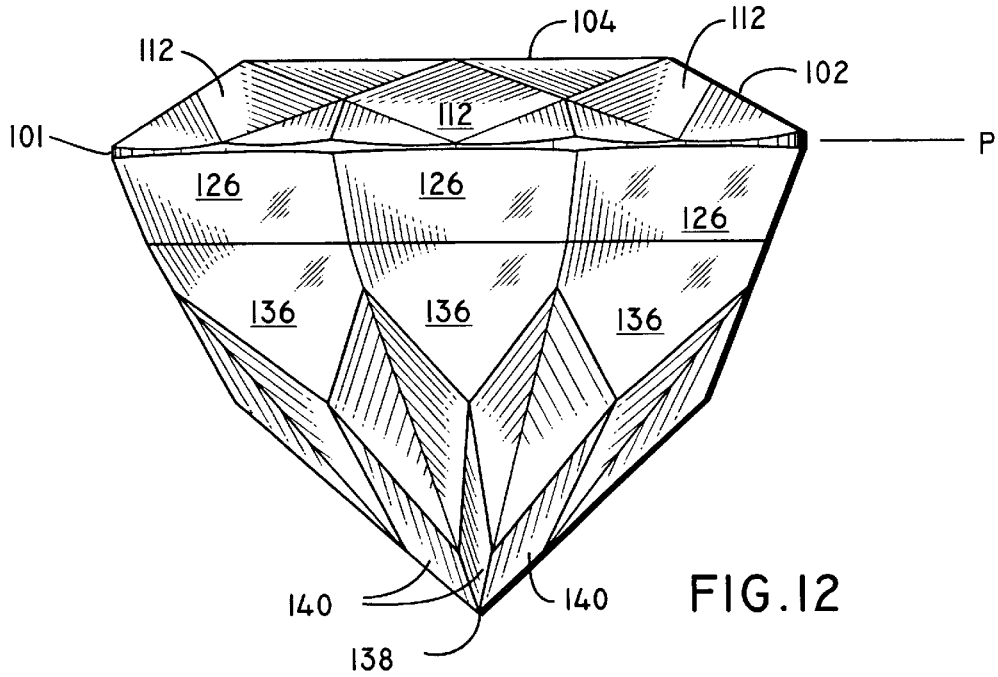
FIG. 12 shows the embodiment of the invention shown in FIGS. 11A and 11B after brillianteering facets have been added.
Figure 14:
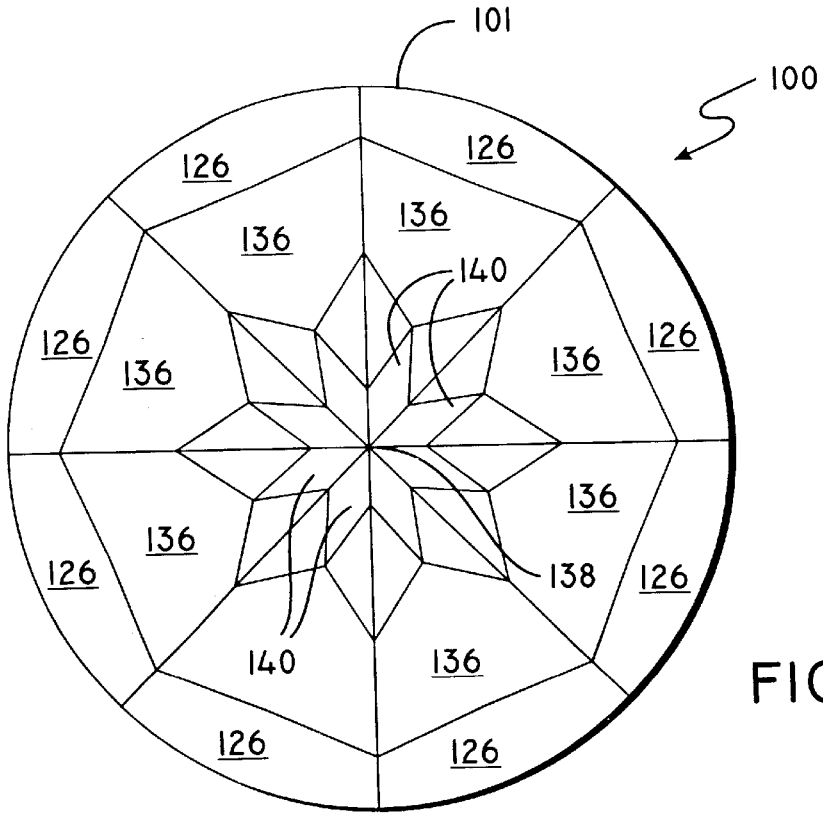
FIG. 14 is a bottom plan view of the diamond of FIG. 12.
Figure 13:
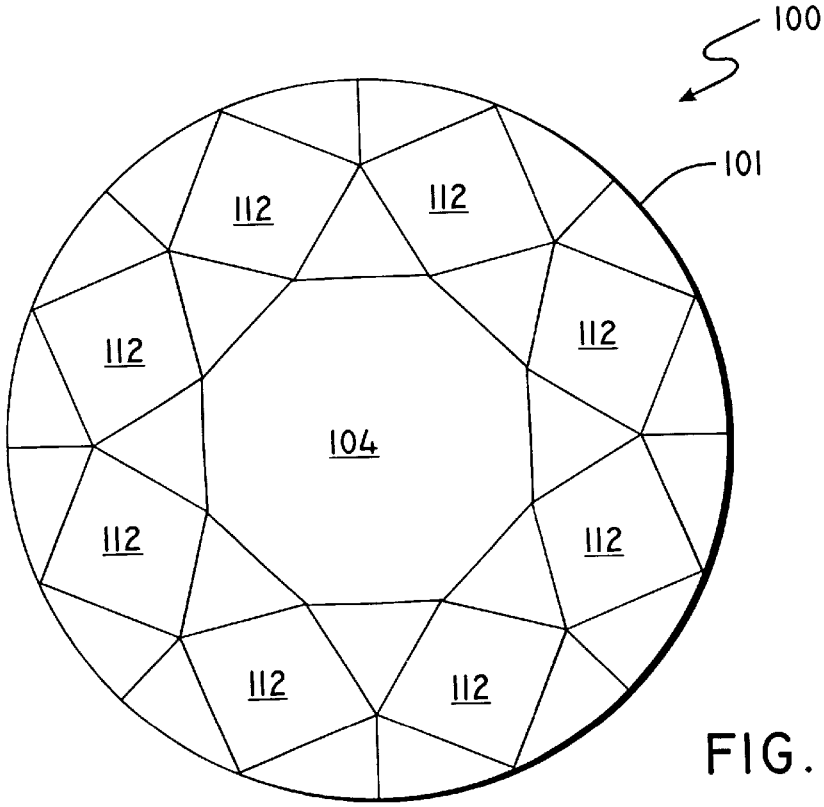
FIG. 13 is a top plan view of the diamond of FIG. 12.

FIGS. 12 through 14 show an example of brillianteering of stone 100. It is to be understood, again, that the particular brillianteering style chosen is not intended to affect the scope of this invention, but that any brillianteering which would occur to one of skilled in the art is contemplated to be within the scope of this invention.

Figure 15A:
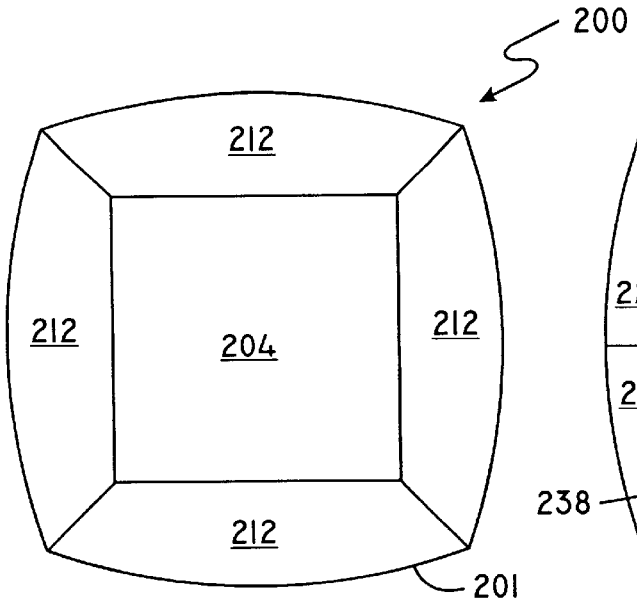
Figure 18:
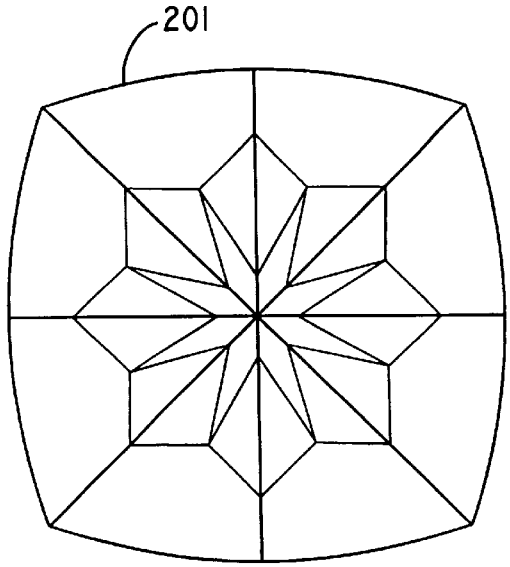
Figure 19:
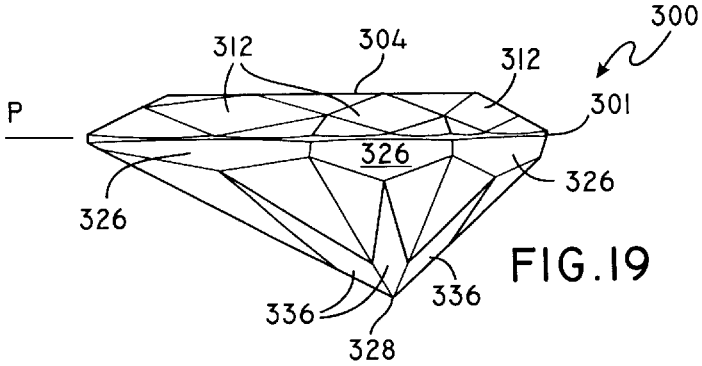
FIGS. 19–23 show a still further embodiment of this invention in which a "pear" shaped diamond is employed but which otherwise follows the principles of this invention.
Figure 20:
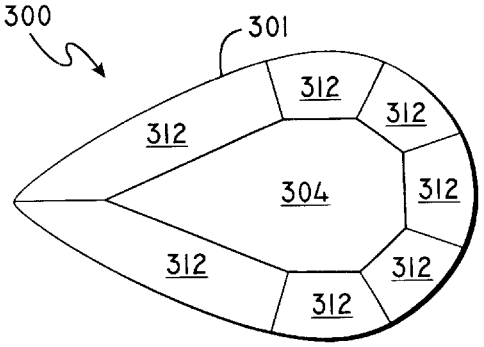
Figure 21:
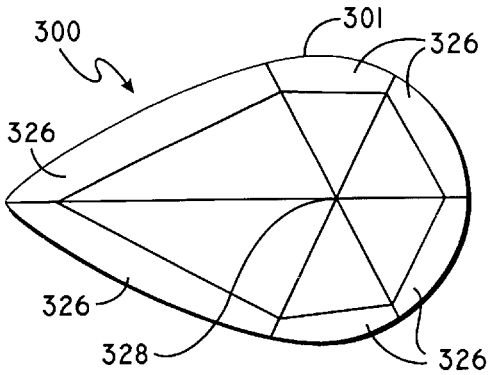
Figure 22:
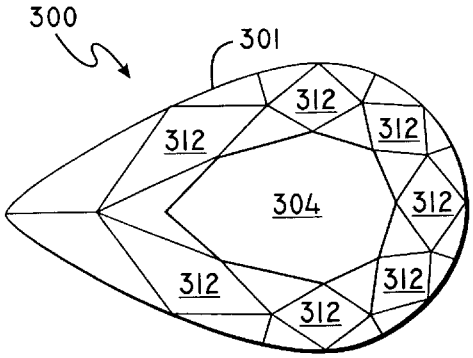
Figure 23:
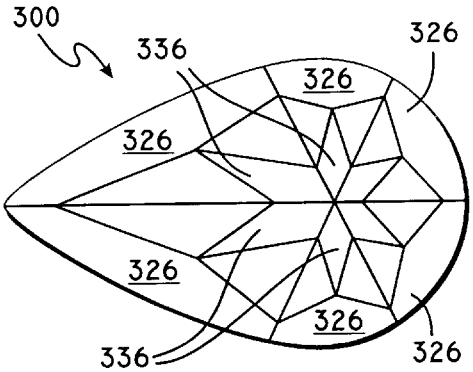
Figure 26:
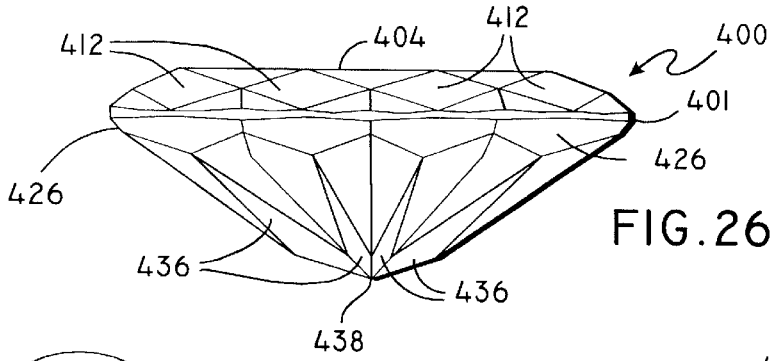
FIGS. 24–28 show an even further embodiment of this invention in which an "oval" cut is employed but which otherwise follows the principles of this invention.
Figure 24:
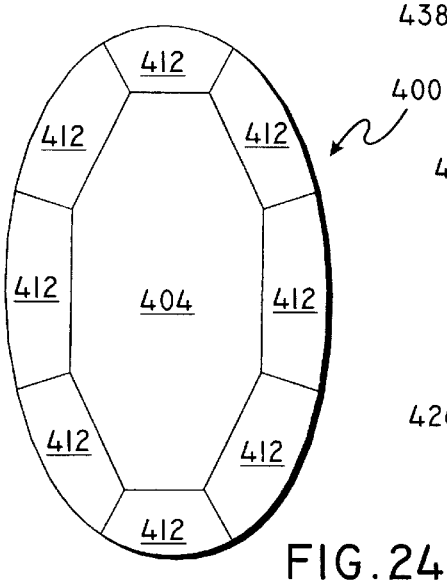
Figure 25:
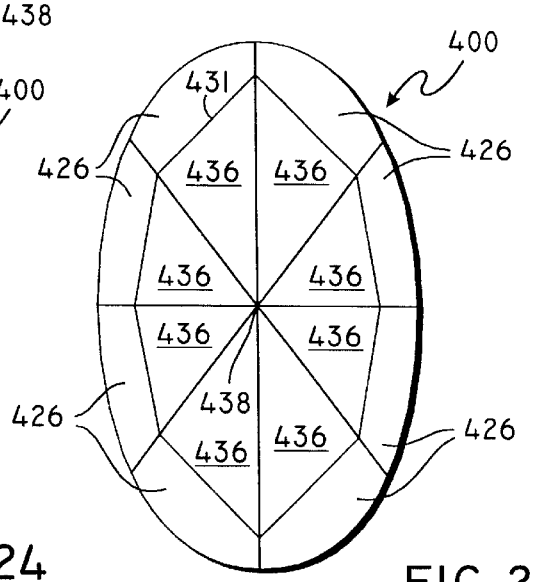
Figure 27:
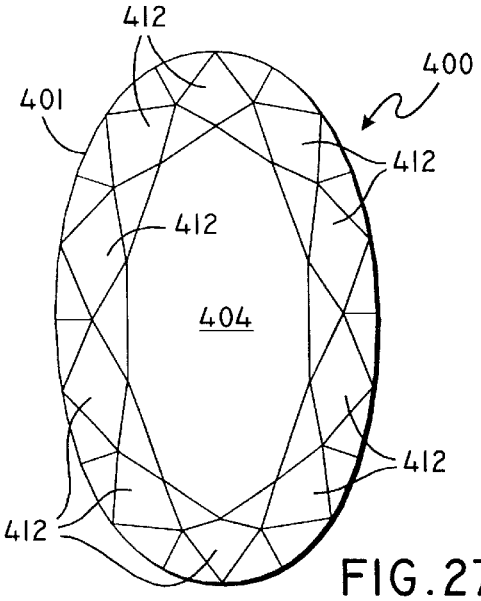
Figure 28:
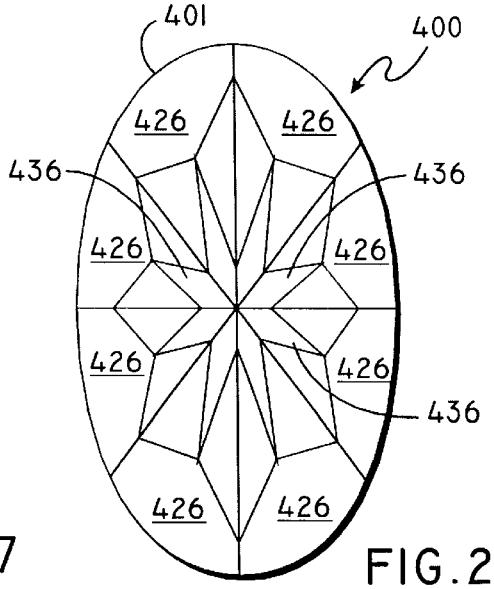
Figure 31:
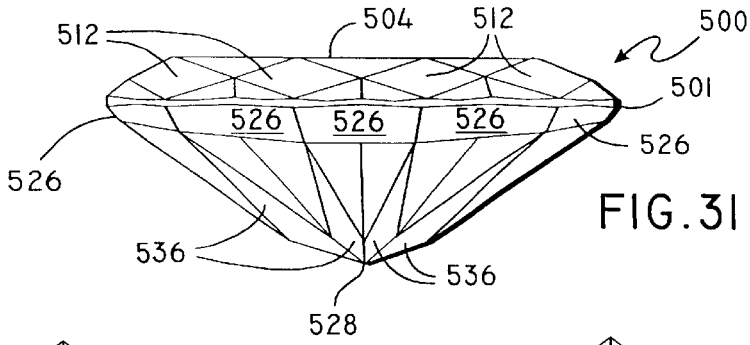
FIGS. 29–33 show yet another embodiment of this invention in which a "marquis" cut is employed but which otherwise follows the principles of this invention.
Figure 29:
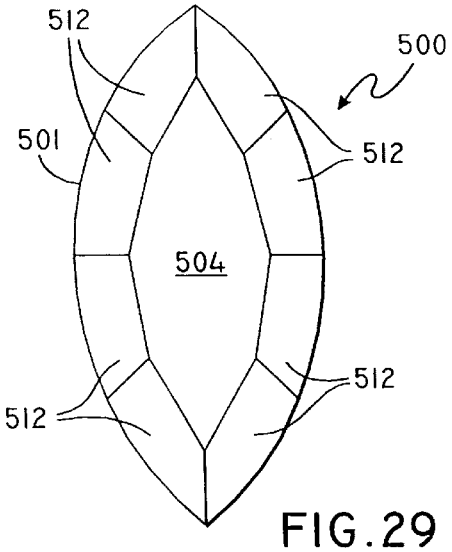
Figure 30:
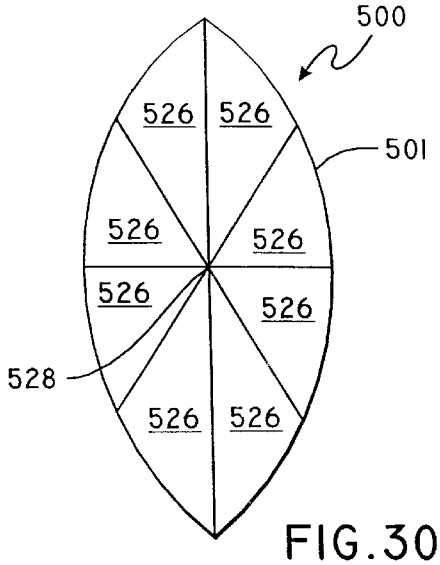
Figure 32:
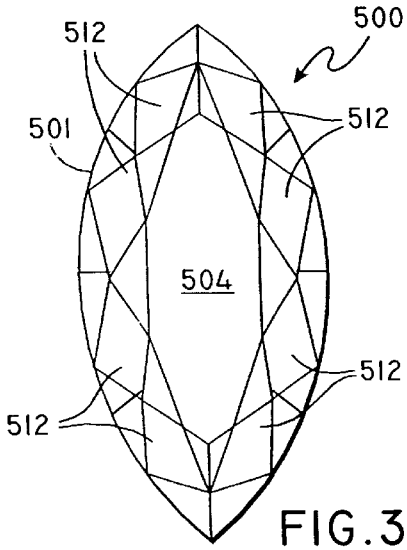
Figure 33:
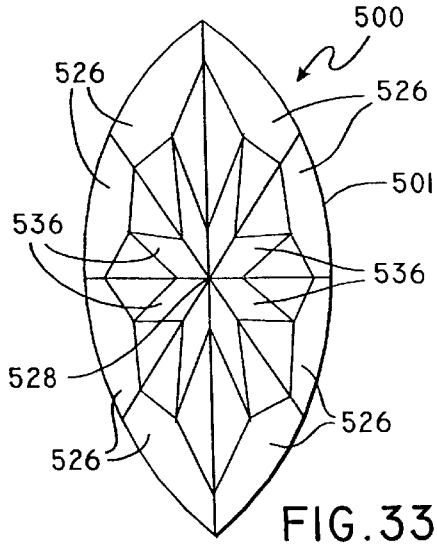

Referring to FIGS. 15A and 18, there is shown a cushion cut diamond 200 manufactured in accordance with this invention in which there is provided a table 204, anywhere with from 4 to 16 main crown facets 212 at an angle of between 26° and 35° to the girdle plane, anywhere from 4 to 16 upper pavilion facets 226 beginning at girdle 201 and ending at a point between the girdle and the bottom of the rough stone chosen by the cutter, and from four to sixteen lower pavilion facets 236 extending from bottom of upper pavilion facets 226 to culet 238. A rib line 230 is formed between upper and lower pavilion facets 226, 236, respectively. Main pavilion facets 226 are oriented at an angle of between 45° and 80° relative to the girdle plane, while lower pavilion facets 236 are oriented at the standard, e.g. 40.75%, angle relative to the girdle plane.

Figure 16:
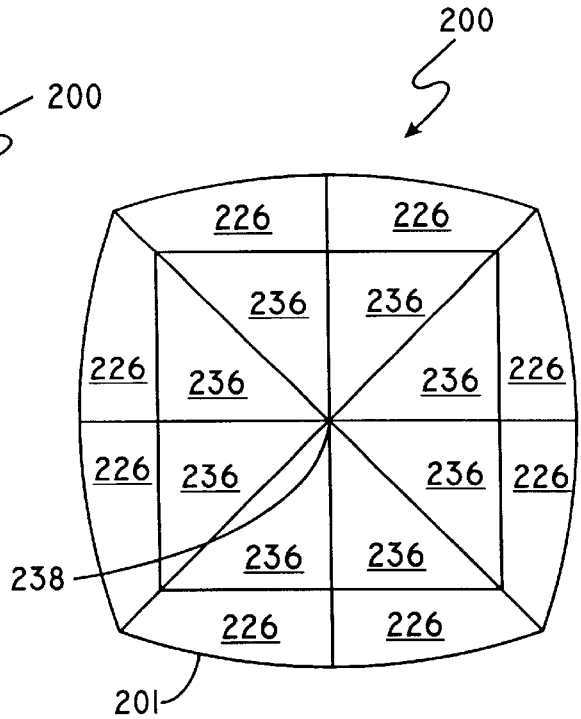
Figure 17:
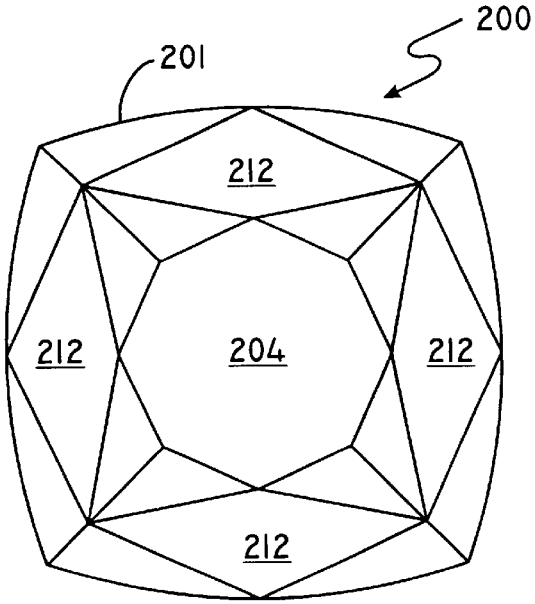

FIGS. 17 and 18 show the cushion cut diamond of FIGS. 15 and 16 after brillianteering.

FIGS. 19 through 23 show a still further embodiment of this invention in which a diamond is cut into a pear shape in accordance with the principles set forth herein. Anywhere from four to sixteen main crown facets 312 are provided surrounding a table 304. The crown facets 312 terminate in a girdle 301. Anywhere from four to sixteen upper pavilion facets 326 are provided below girdle 301. Also, a similar number of lower pavilion facets 336 are provided, and additional brillianteering facets added as desired by the cutter. Rib line 330 is positioned somewhere between 20% and 80% of the way between girdle 301 and culet 338.

The method for manufacturing diamonds of FIGS. 19 through 23 includes the steps of (not necessarily in any particular order) blocking a rough diamond by cutting a table 304, main crown facets 312 and upper pavilion facets 326. Main crown facets are oriented at an angle of between 23° to 40° relative to girdle plane P. Upper pavilion facets 326 are oriented at an angle of between 43° and 80° relative to the girdle plane. Lower pavilion facets 336 are preferably oriented at an angle of between 30° and 45° relative to girdle plane P or at any conventional angle known in the art. Thereafter brillianteering facets may be added as deemed necessary by the cutter.

Referring now to FIGS. 24 through 28, an oval shaped diamond 400 in accordance with the invention is shown. As in the previously described embodiments, a table 404 is provided, along with anywhere from four to sixteen main crown facets 412 and anywhere from four to sixteen upper pavilion facets 426. Also, lower pavilion facets 436 are provided, being oriented at an angle of between 35° to 45° relative to plane P or at any customary angle relative to the girdle plan, ending in a culet 438. Upper pavilion facets 426 are oriented at an angle relative to the girdle plane of between 45° and 80°. Crown facets are oriented at an angle to the girdle plane of between 23° and 40°.

Diamond 400 is initially formed (not necessarily in any particular order) by providing upper pavilion facets 426 extending downwardly from girdle 401. Main crown facets 412 are also provided at an angle of between 23° and 40° relative to the girdle plane, and a table 404 is cut. Lower pavilion facets 436 are provided at an angle of between 35° and 45°, and extend from rib line 431 to culet 438. Rib line 431 is positioned between 20% and 80% of the distance measured from the girdle 401 to culet 438.

Referring now to FIGS. 29–33, an alternative marquis-shaped diamond 500 is shown in accordance with this invention. As in the previously described embodiments, a table 504 is provided, along with anywhere from four to sixteen main crown facets 512 and anywhere from four to sixteen upper pavilion facets 526. Also, a like number of lower pavilion facets 436 are provided, extending from rib line 530 to culet 528. Rib line 530 is positioned anywhere from one fifth to four fifths the vertical distance from girdle plane P to culet 528.

Diamond 500 is initially formed (not necessarily in any particular order) by providing upper pavilion facets 426 at an angle of between 23° and 40° relative to the girdle plane. Upper pavilion facets 526 are oriented at an angle relative to the girdle plane of between 45° and 80°. Lower pavilion facets 536 are oriented at an angle of between 35° and 45° relative to the girdle plane P, and extend from rib line 530 to culet 528.

Figure 36:
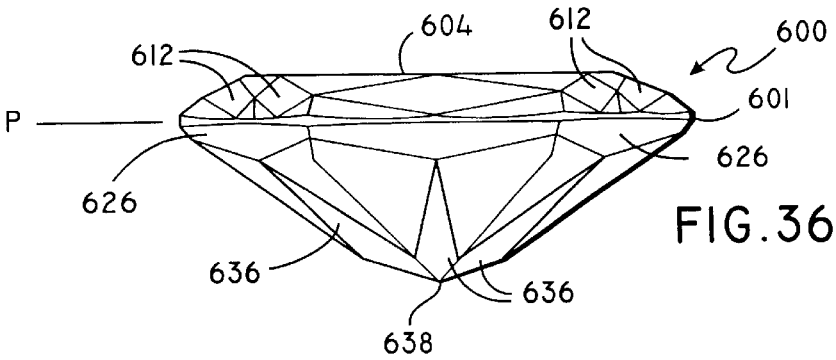
FIGS. 34–38 show another "oval" cut diamond which follows the principles of this invention.
Figure 34:
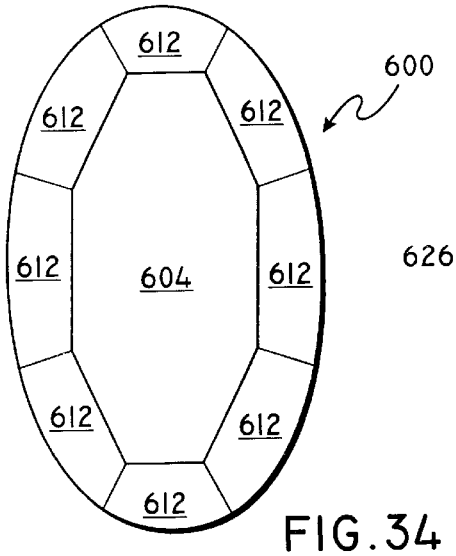
Figure 35:
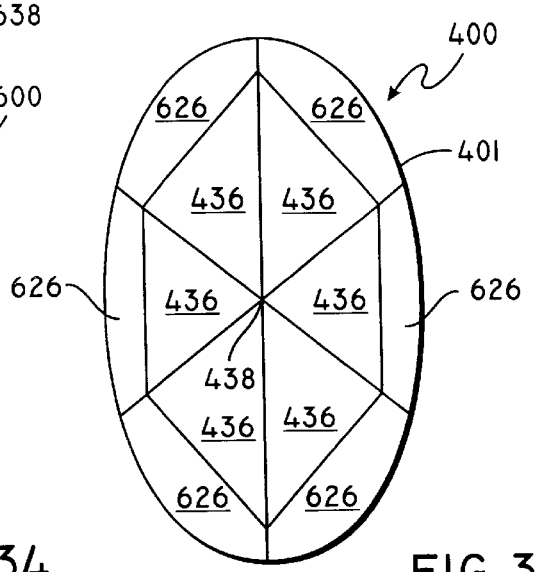
Figure 37:
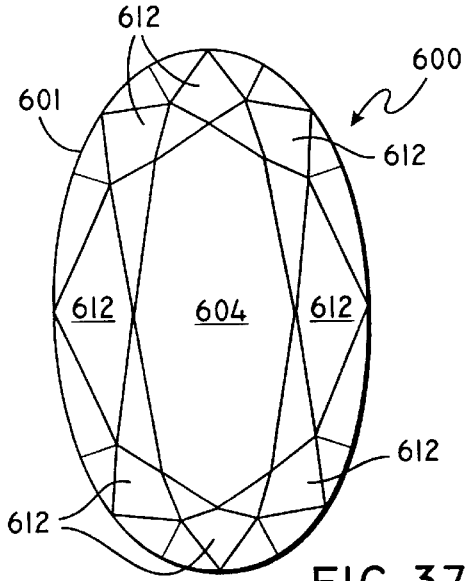
Figure 38:
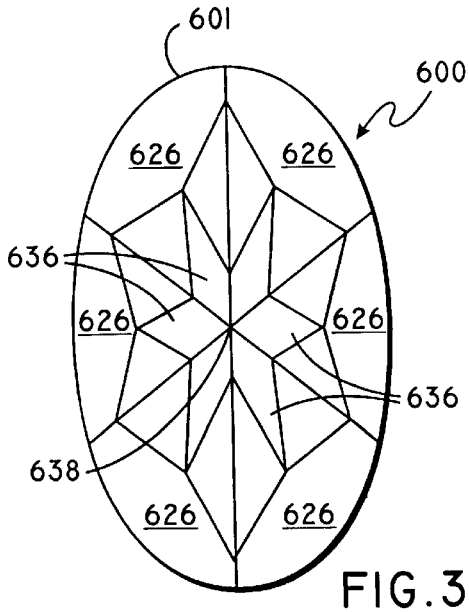
Figure 41:
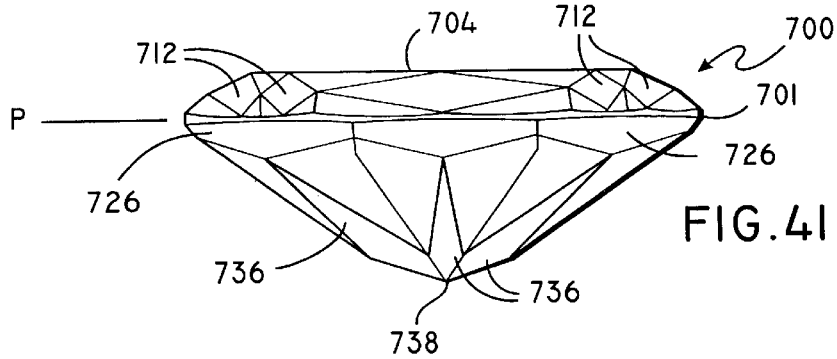
FIGS. 39–43 show another "marquis" cut diamond which follows the principals of this invention.
Figure 39:
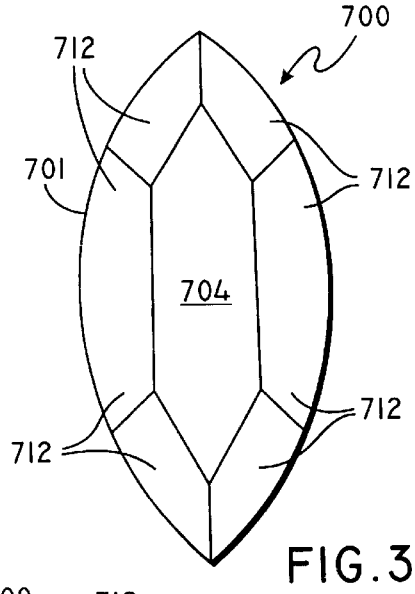
Figure 40:
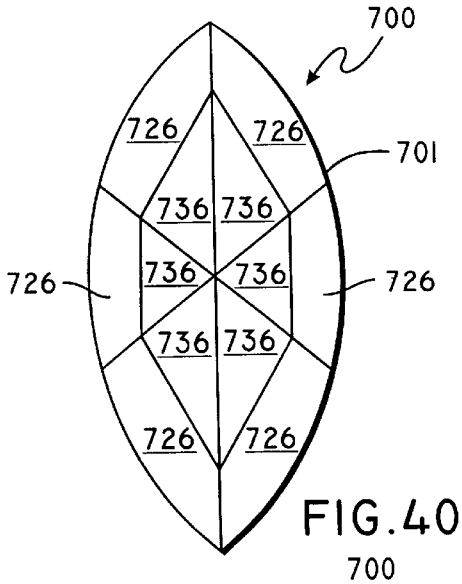
Figure 42:
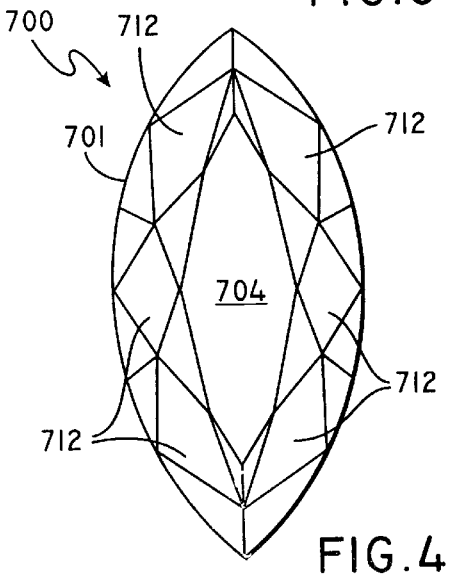
Figure 43:
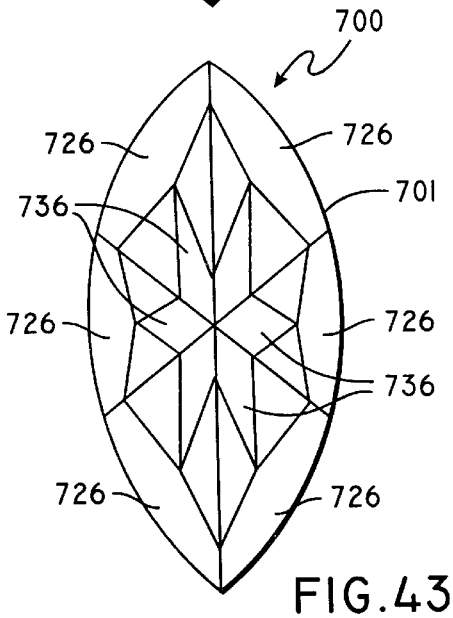

Referring now to FIGS. 34–38, an alternative oval shaped diamond 600 in accordance with the invention as shown. A table 604 is provided, along with anywhere from four to sixteen main crown facets 612 and anywhere from four to sixteen upper pavilion facets 426. Also, a like number of lower pavilion facets 436 are provided, being oriented at an angle of between 35° and 45° relative to plane P or at any customary angle relevant to the girdle plane, ending in a culet 638. Upper pavilion facets 626 are oriented at an angle relative to the girdle plane of between 45° and 80°. Main crown facets 612 are oriented at an angle to the girdle plan of between 23° and 40°. Rib line 630 is positioned anywhere between one fifths and four fifths the vertical distance between girdle 601 and culet 638. Lower pavilion facets 636 are preferably oriented at between 37° and 44° relative to the girdle plane. FIGS. 36, 37 and 38 show the diamond of this embodiment after brillianteering facets have been added as well.

Referring now to FIGS. 39–43, an alternative marquis shaped diamond 700 in accordance with the invention as shown. In table 704 is provided, along with anywhere from four to sixteen main crown facets 712 and anywhere from four to sixteen upper pavilion facets 726. Also, lower pavilion facets 736 are provided, being oriented at an angle of between 35° and 45° relative to the plane P or at any customary angle relative to the girdle plane, ending in a culet 738. Upper pavilion facets 726 are oriented at an angle relative to the girdle plane of between 45° and 80°. Main crown facets 712 are oriented at an angle to the girdle plane of between 23° and 40°.

Diamond 700 is initially formed (not necessarily in any particular order) by providing upper pavilion facets 726 extending downwardly from girdle 701. Main crown facets 712 are also provided at the angle of between 23° and 40° relative to the girdle plane before after table, 404 is cut. Relatively in facets 436 extend between rib line 730 and culet 738. Rib line 730 is positioned between one fifth and four fifths the vertical distance between girdle 701 and culet 738.

Although experimentation is ongoing, the inventors have discovered that blocking a diamond in accordance with this invention has yielded a percentage of crown height in a range of 7% to 13% with crown break angles of as low as 23.5°. Another example of a diamond cut in accordance with this invention had a percentage of crown height of 8.9% and a percentage of crown height of 26.5%. Another stone which was cut in accordance with the principles of this invention had a percentage of crown height of 8.4% at the crown break angle of 24.5°. By utilizing a shallower crown break angle, higher girdles are obtained along with the surprising result that the stones still optically perform in a manner which is indistinguishable from prior art diamonds. And, by otherwise blocking the diamond in accordance with the diamonds, substantially higher carat yields are obtained.

As specified in connection with all embodiments, the sequence of cuts made during the blocking phase is irrelevant, so long as the resulting diamond has the arrangement of facets within the specified ranges as contemplated by the invention prior to brillianteering. For example, the upper pavilion facets may be cut first, or the main crown facets may be cut first, or the lower pavilion facets may be cut first, or the table may be cut first. Also for example, the upper pavilion facets may be cut second or third if the table or crown facets are cut first, or the crown facets may be cut second or third if the pavilion and table facets are cut prior thereto, or the table may, be cut second or third if either the crown or the pavilion facets are cut first. For multiple upper pavilion facet arrangements such as that shown in FIGS. 11A–14, the uppermost pavilion facets should be cut first to maximize yield. However, the actual sequence of blocking steps will be selected by the cutter based on such parameters as the shape and grain structure of the rough diamond.

What is claimed is:

1. A high yield diamond comprising:

a generally planar table lying in a table plane;

a circumferential girdle lying in a girdle plane, the table plane being substantially parallel to the girdle plane;

a plurality of main crown brillianteering facets lying between the table and girdle at an angle between 23° and 40°;

a pavilion lying between the girdle and a culet;

the pavilion comprising:

a plurality of upper pavilion brillianteering facets lying between the girdle and a first pavilion rib line;

a plurality of lower pavilion brillianteering facets lying between the rib line and the culet;

the upper pavilion facets lying at an angle of between 50° and 72° relative to the girdle plane;

the lower pavilion facets lying at an angle of between 35° and 45° relative to the girdle plane; and the rib line lying at a point between one fifth and four fifths of the distance between the girdle and the culet.

2. A generally high yield diamond comprising:

a planar table;

a plurality of upper pavilion brillianteering facets oriented at an angle of between 45° and 80° relative to a plane coincident with the table;

a plurality of main crown brillianteering facets oriented at an angle of between 23° and 40° relative to the table plane;

a girdle positioned between the main crown facets and the upper pavilion facets;

a plurality of middle pavilion brillianteering facets oriented at an angle of between 46° and 70° relative to the table plane; and a plurality of lower pavilion brillianteering facets which converge to a culet at a bottom of the diamond, said lower pavilion facets bordering the middle pavilion facets at a rib line, said rib line lying at a position between 20% and 80% of a distance between the girdle and the culet.

3. A high yield diamond comprising:

a generally planar table lying in a table plane;

a girdle lying in a girdle plane;

a plurality of main crown brillianteering facets lying between the table and girdle at an angle of between 23° and 40°;

a plurality of upper pavilion brillianteering facets below the girdle at an angle of between 45° and 80° relative to the girdle plane;

a plurality of middle pavilion brillianteering facets lying below the upper pavilion facets oriented at an angle of between 46° and 70° relative to the girdle plane; and a plurality of lower pavilion brillianteering facets below the middle pavilion facets lying at an angle of between 38° and 44° relative to the girdle plane;

the middle pavilion facets and lower pavilion facets forming a rib line therebetween which is parallel to the girdle plane and which lies somewhere between one fifth a distance between the girdle plane and a culet of the diamond and four fifths of the distance between the girdle plane and the culet such that the upper and middle pavilion facets extend between 20% and 80% of the distance between the girdle plane and the culet.

4. The diamond of claim 3, wherein the main crown facets have a height, said height relative to the diameter of the girdle being between 7% and 13%.

* * * * *